United States Patent [19]

Vallance

[11] 4,352,638

[45] Oct. 5, 1982

[54] ROTOR ASSEMBLY FOR WAVE COMPRESSION SUPERCHARGER

[75] Inventor: James K. Vallance, Northville, Mich.

[73] Assignee: Ford Motor Company, Dearborn, Mich.

[21] Appl. No.: 90,948

[22] Filed: Nov. 5, 1979

[51] Int. Cl.[3] ..... F04F 11/02

[52] U.S. Cl. ..... 417/64; 416/DIG. 3

[58] Field of Search ..... 417/64; 60/39.45 A; 123/559; 416/DIG. 3

[56] References Cited

U.S. PATENT DOCUMENTS

| | | | |
|---|---|---|---|
| 3,101,168 | 8/1963 | Berchtold | 417/64 |
| 3,221,981 | 12/1965 | Spalding | 417/64 |
| 3,291,380 | 12/1966 | Brown et al. | 417/64 |
| 3,458,116 | 7/1969 | Winkler et al. | 417/64 |
| 3,556,680 | 1/1971 | Leutwyler et al. | 417/64 |

*Primary Examiner*—Carlton R. Croyle

*Assistant Examiner*—Edward Look

*Attorney, Agent, or Firm*—Frank G. McKenzie; Donald J. Harrington

[57] ABSTRACT

A supercharger for compressing air supplied to an engine having an intake manifold and an exhaust gas manifold wherein the energy of the exhaust gas is used to increase the intake manifold air pressure, the supercharger having a rotor with radially extending vanes that define a plurality of rotating cells therebetween, exhaust gas inlet and outlet ports at one end of the rotor, air inlet and outlet ports at the other axial end of the rotor, which ports open communication between the engine exhaust manifold and the engine inlet manifold respectively as the rotor rotates each cell into alignment with the ports, the rotor vanes being formed with a stiffening bead and being arranged around the rotor circumference so that they are spaced from one another by an unequal amount that may very either uniformly or nonuniformly around the rotor.

4 Claims, 9 Drawing Figures

FIG. 2.
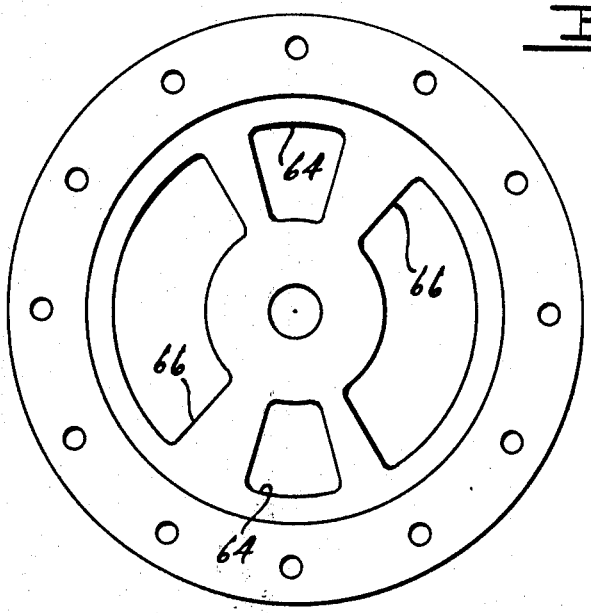
FIG. 3.
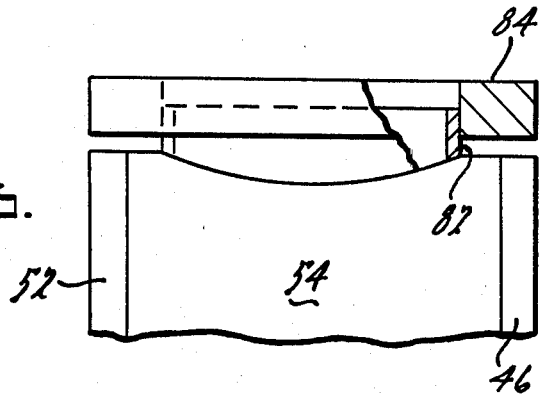
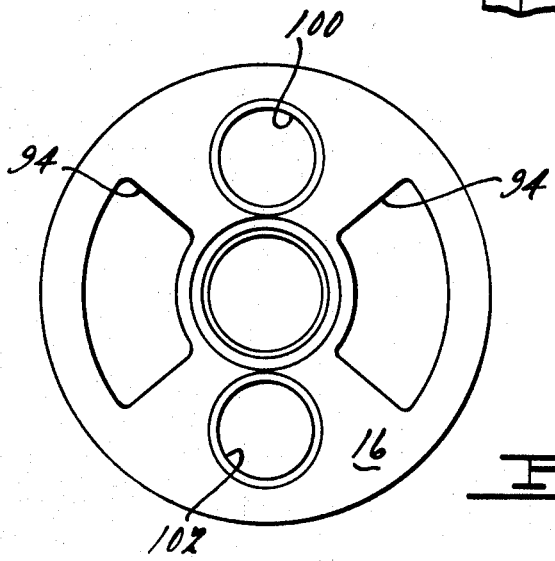
FIG. 4.

ROTOR ASSEMBLY FOR WAVE COMPRESSION SUPERCHARGER

BACKGROUND OF THE INVENTION

1. Field of the Invention

This invention relates to improvements in a wave compression supercharger, and more particularly, to an improved rotor for such a device having vanes formed with an axially extending bead which are mounted round the circumference of the rotor with a non-uniform spacing therebetween.

2. Description of the Prior Art

A wave compression supercharger of the type to which this improvement applies generally includes a rotor having a plurality of axially extending vanes mounted on the outer circumference of the rotor. The rotor is mounted on a shaft that is driven from the crankshaft of the engine by way of a belt and pulley. Stator plates are located at the axial ends of the rotor and provide, by way of ports formed through their thickness, passageways for the flow of exhaust gases and air to the rotor.

The vanes extend radially outwardly from the outer surface of the rotor upon which they are mounted, and the outer ends of the rotor vanes are generally joined to a cylindrical shroud that extends axially along the length of the rotor. In this way, gas or air channels are defined along the rotor length by the space between the rotor vanes, in the circumferential sense; by the outer rotor surface and the inner surface of the shroud, in the radial sense; and by the stator plates at the opposite ends of the rotor, in the axial sense. Typically, the rotor vanes are thin, rectangular plates of sheet steel, usually about 0.030 inches thick, perhaps an inch wide and four inches long for a typical automotive application.

Exhaust gas from an internal combustion engine at a relatively high pressure is admitted to a compression wave supercharger through the gas inlet port formed through the thickness of a stator plate located at one end of the rotor. Exhaust gas at reduced pressure exits a compression wave supercharger through the exhaust ports formed in the gas stator plate, which ports are spaced circumferentially from the gas inlet ports and are generally somewhat larger at the axially opposite end of the turbocharger. Ambient air enters the turbocharger through an inlet port formed through thickness of an air stator plate, and compressed air at a higher pressure than ambient conditions exits the supercharger through air exit ports formed through the air stator plate, but spaced circumferentially from the air inlet port.

The essential function of the wave compression supercharger is to provide means for an exchange of energy from the high pressure exhaust engine gas to the ambient air, whereby the inlet air is compressed and admitted to the intake manifold of the engine and the engine exhaust gas is expanded and delivered back to the exhaust system of the vehicle. In realizing this energy exchange, the high pressure exhaust gas produces a compression wave front in the axially extending channels. This wave compresses the inlet air and pumps the air from the supercharger into the engine intake manifold. As the rotor turns, the individual axial channels are sequentially exposed, on the one rotor side, first to the exhaust gas inlet port and later, during the rotor cycle, to the exhaust gas outlet port. At the axially opposite rotor end, the axial channels are sequentially exposed first to the ambient air inlet port and later, during the rotor cycle, to the compressed air exit port.

It is essential in the design of wave compression superchargers to maintain minimal clearances among the various components that define and contain the air volume within the channels. Consequently, the channels experience a cyclic pressure cycle from a low pressure condition when ambient air pressure prevails within the channel, to an extreme wherein the exhaust gas pressure wave is progressing axially along the channel. During a single rotor cycle, typically, the channels experience two pressure cycles because the inlet and outlet ports on the gas and air stator plates are symmetrically arranged about the diameter of the stator plates.

A high frequency siren-like noise is an operating characteristic of a wave compression turbocharger and is recognized to be a serious problem in automotive usage. Air and gas leakage in a wave compression turbocharger, by way of clearances between the rotary and stationary parts, particularly in the vicinity of the stator plate ports and between the axial ends of the rotor and the inner surfaces of the stator plates, produces high frequency noise. A further source of noise is the resonant vibration of the gases within the rotor cells. Vibratory response of the thin walled vanes to the resonant excitation within the cells is a further source of unwanted noise.

The power of a spark ignition or compression ignition engine is directly limited by the amount of air that can be inducted into the engine during the intake stroke. The air induction can be increased by increasing the number and size of the cylinders, or, to save weight, by using a compressor to supercharge the cylinder with air or the air/gas mixture. A supercharged engine, therefore, has an overall higher compression ratio and the charge is increased in density and temperature at ignition, as compared to engines without supercharging. The purpose of supercharging, then, is to maximize the amount of air inducted into the engine. Air expands when heated; therefore, it is desirable that the compressed air exiting a supercharger and entering the intake manifold of an engine be at a relatively low temperature and at a relatively high pressure. In this way, the density of the air is increased and the flow into the engine maximized.

As the incoming shock wave enters the rotor cell from the engine exhaust side and progresses along the axis of the supercharger, mixing of the exhaust gas with the ambient air present within the cell usually occurs to some extent. It is an object of supercharger design practice to minimize this mixing and in this way to lessen the amount of exhaust engine gas that is readmitted to the engine with the compressed air that leaves the supercharger. This mixing and return of exhaust engine gas is known as exhaust gas recirculation and should be held to a minimum for reasons of economy of operation and environmental protection.

In order to reduce the temperature of the air exiting the compressor and before its induction into the engine, engine cooling water is circulated through an aftercooler to remove heat from the air and, in this way, to reduce its volume, thereby increasing the flow rate of air into the engine. The temperature of the air that is compressed in and pumped from the supercharger is, therefore, a measure of the amount of exhaust gas recirculation. Preferably, the temperature of the air delivered to the engine is held to a minimum.

SUMMARY OF THE INVENTION

The present invention relates to a wave compression supercharger which is useful in at least partially reducing noise resulting from vibration induced within the supercharger as a result of the instability of the shock wave that progresses down the rotor cell between the rotor blades. Vibrations induced by this source are known to have produced structural failures between the rotor blades and the rotor, particularly in the area adjacent the inlet stator plate. In one aspect of this invention, the bending stiffness of the rotor blades is increased by forming the blades so as to produce an axial bead to thereby increase its bending resistance through the thickness of the rotor blade.

Unwanted noise, particularly high frequency noise, is further reduced with this invention by means of locating each rotor blade around the circumference of the rotor at an angular position, with respect to the adjacent blades, that varies around the circumference. In this way, the characteristic siren-like effect is minimized substantially from that which is present in superchargers having the rotor blades equally spaced around the rotor circumference.

A desirable and unexpected increase in the compressor exhaust gas pressure and a substantial reduction in exhaust gas temperature results from the use of a supercharger having a rotor whose rotor blades are formed with an axially extending bead of the type described herein.

BRIEF DESCRIPTION OF THE DRAWINGS

FIG. 2 is a front view of the gas flow stator plate showing the exhaust gas inlet and outlet ports formed through its thickness.

FIG. 3 is a top view of a portion of the far side of the air duct assembly shown in FIG. 1.

FIG. 4 is a front view of the bearing housing showing the air inlet and outlet ports formed through its thickness.

DESCRIPTION OF THE PREFERRED EMBODIMENT

Figure 1:
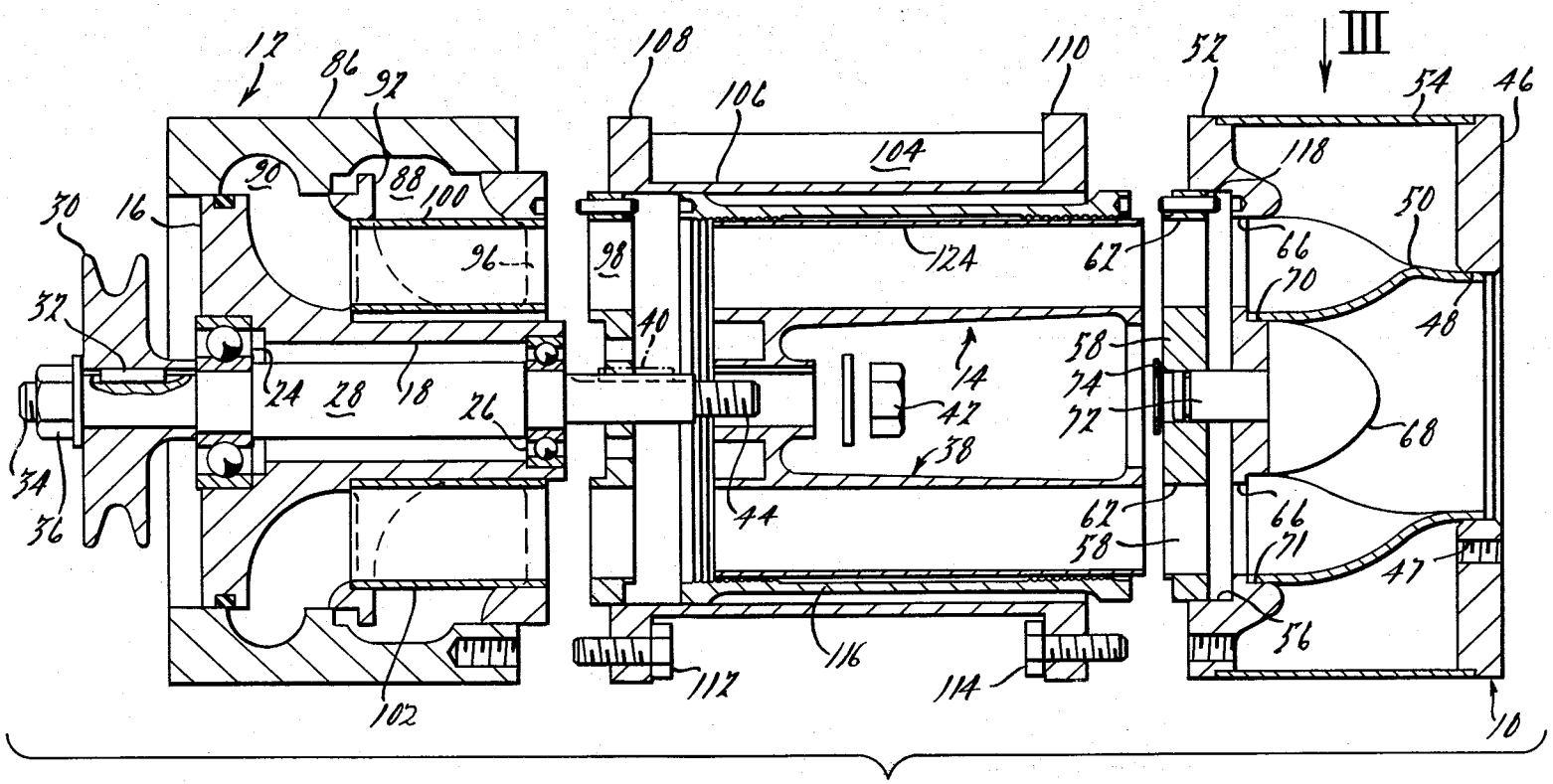
FIG. 1 is an elevation cross-section of a wave compression supercharger showing certain individual parts axially spaced with respect to one another.
Figure 5:
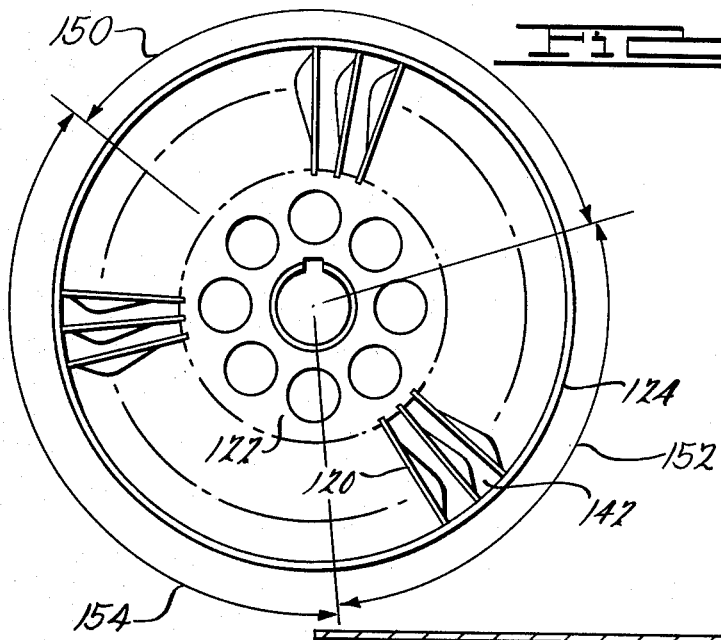
FIG. 5 is an end view of the rotor showing the rotor vanes mounted radially around the rotor hub.
Figure 6:
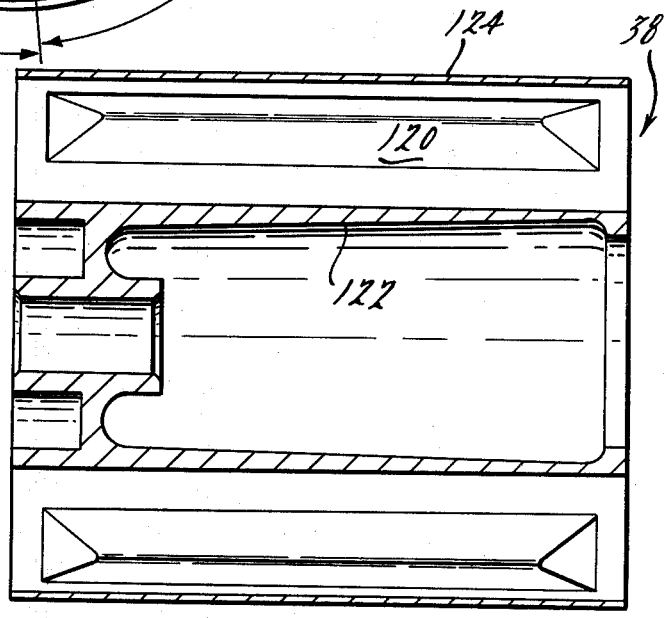
FIG. 6 is a side elevation of the rotor assembly of FIG. 5.

Referring first to FIG. 1, a wave compression supercharger according to the present invention includes an exhaust gas duct assembly 10 positioned at one axial end, an air duct assembly 12 located at the opposite axial end, and a rotor assembly 14 positioned between the duct assemblies.

The air duct assembly 12 includes a bearing housing 16 which has an axial bore 18 extending along its length establishing its principal inside diameter, and recesses 20 and 22 formed on the bore 18 into which are fitted roller bearings 24 and 26. A pulley 30 is secured at the keyway 32 to the overhung outer surface of the shaft 28 mounted within housing 16 on the bearings. In this way, torque from the engine crankshaft is delivered to the pulley by way of a belt and rotation of the shaft about its central axis results. The pulley 30 is retained on the shaft by the engagement of a nut 36 on the externally threaded portion 34 of the shaft 28, which engagement causes the pulley to be drawn up securely and to be retained between bearing 24 and the retaining nut 36. Similarly, at the axially opposite end of shaft 28, rotor 34 is secured against relative rotation with respect to the shaft at a keyway 40 and a retaining nut 42 is drawn up on an externally threaded portion 44 of shaft 28, thereby fixing the rotor 38 on the shaft.

The gas duct assembly 10 includes a circular rear mounting plate 46 having a plurality of tapped holes 47 arranged around a central circular opening 48 into which an inner exhaust duct shroud is fitted. The tapped holes 47 provide a means for attaching the supercharger to the motor vehicle structure.

A port retainer flange 52 located in a plane parallel to the plane occupied by the rear mounting plate 46 is spaced axially therefrom by an outer shroud 54 having the form of a right circular cylinder, mounted upon and joined to plate 46 and the flange 52. A cylindrical bore 56 is formed partially through the thickness of the port retainer flange 52 and provides a recess wherein a gas flow stator plate 58 is mounted.

FIG. 2 illustrates a front view of the gas flow stator plate showing the exhaust gas inlet ports 64 and gas outlet ports 66 formed through the thickness of the stator plate. The port retainer flange 52 has a gas inlet port (not shown) and exhaust gas outlet port 66 having identical geometry and aligned substantially with the inlet and outlet ports 64, 66 of the stator plate 58.

The inner shroud 50 is joined to the port retainer flange 52 on surfaces 70, 71. Mounted within the inner shroud on the axial centerline of the supercharger is a center body 68 having a stub portion 72 that extends through a central opening in the exhaust gas flow stator plate 58 onto which it is mounted by a retaining ring 74. The inner shroud has cylindrical inlet and an outlet at each axial end. Between its ends, an axial well is gradually formed having a depth and width slightly greater than that of the gas outlet ports 66 of the stator and flange plates 58, 52, respectively. The center body 68 abuts the inner surface of the wells and prevents the flow of exhaust gas through the inlet orifice from passing through the outlet ports 66. Instead, incoming exhaust gas is required to flow through the inlet ports 64, which are best illustrated in FIG. 2. When exhaust gas exits through the ports 66, the outer surface of the inner shroud seals the incoming exhaust gas from the outlet exhaust gas. As illustrated in FIG. 3, the outer shroud is intersected by a duct 82 which directs the flow of the exiting exhaust gas outwardly from the supercharger and into the exhaust system of the motor vehicle to which it is mounted at flange 84.

At the left end of the supercharger, as shown in FIG. 1, the air duct assembly 12 includes an air duct 86 having inner surfaces 88, 90 that align axially with mating interior surfaces of the bearing housing 16. A web portion 92 of the bearing housing 16 seals chamber 88 from 90 and provides a surface onto which air duct 86 is mounted. An inlet orifice (not shown) communicates with chamber 88 and carries inlet air at ambient conditions into the supercharger. Inlet air enters the rotor through air inlet ports 94, as shown in FIG. 4, formed through the thickness of the bearing housing 16 and similarly shaped and aligned air inlet ports formed through the thickness of the stator flow plate 98. Air exits the supercharger by passing through an exit port (not shown) formed through the thickness of the air flow stator plate 98, the right wall 96, and the web 92 of the bearing housing 16. The cylinders 100,102 are, of course, aligned with the exit ports in the air flow stator plate 98. Exiting air passes into chamber 90 and exits the air duct 86 through an intersecting duct that carries the exit air into the inlet manifold of the internal combustion engine. A rotor housing 104 has a cylindrical shroud portion 106 that extends axially between flange portion 108, 110. The flanges are mechanically attached at a bolt circle 112 to the air duct that provides a tapped hole engagement with the bolts, and by a similar bolt circle 114 that aligns with a plurality of tapped holes formed in the port retainer flange 52.

A spacer shroud 116 is located within the rotor housing and extends between the gas flow stator 58 at the one end, and the air flow stator plate 98 at the opposite end. The spacer shroud 116 receives spring pins 118 in its axially opposite faces. The spring pins extend through stators 58, 98, and into the adjacent retainer flange 52 and bearing housing 16. The spring pins thereby position and align the inlet and outlet gas and air ports enabling flow of the engine exhaust gas and the air toward and away from the supercharger.

The rotor 38 has a plurality of rotor vanes, as illustrated in FIGS. 5–9, that extend radially outwardly from the rotor hub 122 and are spaced around the circumference of the hub. The vanes are circumferentially spaced around the hub in one circumferential zone 150 that extends over approximately 126 degrees around the rotor circumference in increments that are 9 degrees apart, one vane from the other. A second zone 152, adjacent the first, extends over approximately 104 degrees of rotor circumference and has vanes within this zone spaced apart approximately 8 degrees of rotor circumference. A third zone 154, adjacent the first and second zones, extends over approximately 130 degrees of rotor circumference and has the vanes spaced apart approximately 10 degrees of rotor circumference. Alternatively, zones 150, 152, 154 may each extend over approximately equal portions of the rotor circumference, but the valve spacing differs among the zones. The vanes are joined to the rotor hub 122 by brazing; the radially outermost edges of the vanes are brazed to a circular sleeve 124 that extends axially the full length of the rotor.

Figure 7:
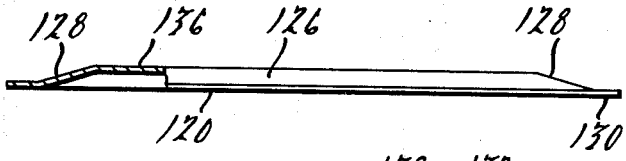
FIG. 7 is a side elevation of a typical rotor vane showing the stiffening bead.
Figure 8:
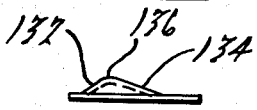
FIG. 8 is an end elevation of a typical rotor vane showing a stiffening bead.
Figure 9:
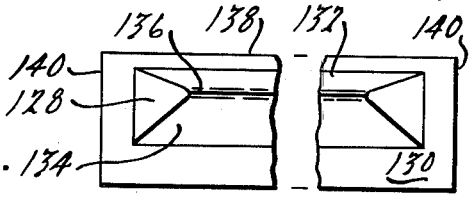
FIG. 9 is a partial top view of a typical rotor vane showing the stiffening bead.

FIGS. 7–9 illustrates a typical rotor vane 120 formed of sheet material having a stiffening bead 126 formed thereon. The bead contour is stamped through the material thickness to produce a maximum depth of about 0.10 inches. The bead tapers at its axial extremities along a 50 degree ramp portion 128 to the flange 130. The flange 130, which extends completely around the periphery of the vane is planar thereby facilitating brazing of the vane to the rotor hub 122 and to the outer sleeve 124. The flange extends axially along the rotor so that the inlet and outlet ports need not be contoured but can be straight sided and axially directed. In the radial sense, the bead tapers from its maximum height along a radially outermost ramp 132 which makes an angle of 30 degrees with respect to the radially extending flange 130. At the radially inner surface, the bead tapers from its maximum height along a radially inner ramp 134, which makes an angle of 15 degrees with the radially extending flange 130. The crest of the bead 136 is located from the outer radial edge 138 of the vane approximately 30 percent of the radial dimension of the vane. In the axial sense the full height of the bead extends approximately 70 percent of the axial length of the vane. The crest of the bead at each axial end is located from the axial edge of the vane 140 approximately 15 percent of the total axial length of the vane.

The rotor, therefore, defines a cell 142 in the space bounded by adjacent vanes 120, the rotor hub 122 and the outer sleeve 124. The relationship between the cells and the ports of the stator plate is carefully chosen so that a pressure wave is established at the gas end of the supercharger and the energy of that wave is used to compress the air that enters the cells through the air intake port 94. The timing of the opening and closing of the four ports 64, 66, 94, 100 is such that the pressure wave compresses the engine intake air, but reflection of the high pressure wave off the air-side port wall is avoided. The compressor porting and cell characteristics are designed to achieve a compression wave phenomena that effects an energy transfer from the exhaust gas to the intake manifold air.

The gas intake port 64 should begin to open just prior to the initiation of a pulse or wave front, and it should close after the wave front is created. The air intake port 94 should close just before the opening of the gas intake port 64.

The air exhaust port 100 should open at an instant after the gas intake port 64 is closed but before the high pressure wave reaches the end of the cell 142 on the air side.

The air exhaust port 100 should close when the high pressure wave impinges on the air side port wall. The exhaust gas port 66 should be opened at an instant just prior to the opening of the air intake port 94.

When an exhaust gas inlet port 94 is opened, the cell 142 is filled with air at ambient conditions because at that instant the air inlet port 94 that is aligned with that particular cell also is opened.

Supercharging takes place as a cell 142, initially filled with low pressure air, passes the high pressure exhaust gas inlet port 64. A compression or shock wave is produced, which travels into the cell ahead of the high pressure engine exhaust gas, thereby compressing the air originally present within the cell. For efficient operation, it is necessary that this pressure wave reach the opposite end of the cell precisely as the cell rotates past the leading edge of the high pressure air exhaust port 100. This high pressure air exhaust port 100 must be sized exactly and the rotor speed timed precisely so that only the compressed air is admitted to the engine intake manifold. The cell must rotate past the port 100 before the exhaust gas, which has progressed axially down the cell, reaches the left end of the cell as shown in FIG. 1.

In approximately the same manner exhaust gas is scavenged from the rotor and fresh air inducted into the supercharger as the rotor passes the low pressure air and gas ports.

Changes and modifications in the specifically described embodiments can be carried out without parting from the scope of the invention which is intended to be limited only by the scope of the appended claims.

Having thus described a preferred embodiment of my invention, what I claim and desire to secure by U.S. Letters Patent is:

1. A compressor for compressing air supplied to an engine having an air intake manifold and an exhaust gas manifold comprising:

a rotor mounted for rotation having a plurality of vanes disposed around the rotor circumference defining axially and radially extending cells therebetween, said vanes being arranged in zones, the vanes of each zone being spaced from adjacent vanes of that zone by a substantially equal distance, the spacing between the vanes of a zone being different from the vane spacing of any other zone, the vanes include a flange portion that extends around the periphery of said rotor vane and a stiffening bead extending axially and radially along the vane and outwardly from the vane surface having a plurality of transition regions extending to the crest of the bead from the flange portion;

an inlet exhaust gas port disposed at a first axial end of said rotor through which high pressure engine exhaust gas enters the rotor cells from the engine exhaust gas manifold;

an outlet exhaust gas port disposed at the first axial end of said rotor through which the engine exhaust gas exits the rotor cells and is returned to the engine exhaust manifold;

an air inlet port disposed at a second axial end of said rotor through which low-pressure air enters the rotor cells;

an air outlet port disposed at a second axial end of said rotor through which the air at a higher pressure exits the rotor cells and is directed to the engine inlet manifold;

wherein engine exhaust gas and air enter and exit the rotor cells as the cells rotate into alignment with the exhaust gas and air inlet and outlet ports whereby the low pressure air is compressed within the cell by the action of a pressure wave that travels axially from the first to the second rotor end, the pressure wave being produced by the engine exhaust gas that enters said inlet exhaust gas port.

2. The compressor of claim 1 wherein the vanes are mounted on the rotor hub such that the bead of each vane faces that surface of an adjacent vane that is opposite from the surface from which the bead extends.

3. A compressor for compressing air supplied to an engine having an air intake manifold and an exhaust gas manifold comprising:

a rotor mounted for rotation having a plurality of vanes disposed around the rotor circumference defining axially and radially extending cells therebetween, the vanes include a flange portion that extends around the periphery of said rotor vane and a stiffening bead extending axially and radially along the vane and outwardly from the vane surface having a plurality of transition regions extending to the crest of the bead from the flange portion;

an inlet exhaust gas port disposed at a first axial end of said rotor through which high pressure engine exhaust gas enters the rotor cells from the engine exhaust gas manifold;

an outlet exhaust gas port disposed at the first axial end of said rotor through which the engine exhaust gas exits the rotor cells and is returned to the engine exhaust manifold;

an air inlet port disposed at a second axial end of said rotor through which low-pressure air enters the rotor cells;

an air outlet port disposed at a second axial end of said rotor through which the air at a higher pressure exits the rotor cells and is directed to the engine inlet manifold;

wherein engine exhaust gas and air enter and exit the rotor cells as the cells rotate into alignment with the exhaust gas and air inlet and outlet ports whereby the low pressure air is compressed within the cell by the action of a pressure wave that travels axially from the first to the second rotor end, the pressure wave being produced by the engine exhaust gas that enters said inlet exhaust gas port.

4. The compressor of claim 3 wherein the vanes are mounted on the rotor hub such that the bead of each vane faces that surface of an adjacent vane that is opposite from the surface from which the bead extends.

* * * * *